US009221066B2

(12) United States Patent
Rodgers

(10) Patent No.: US 9,221,066 B2
(45) Date of Patent: Dec. 29, 2015

(54) MULTI-HEAD ELECTROSTATIC PAINTING APPARATUS

(71) Applicant: Michael C. Rodgers, Rushsylvania, OH (US)

(72) Inventor: Michael C. Rodgers, Rushsylvania, OH (US)

(73) Assignee: Honda Motor Co., Ltd., Toyko (JP)

( * ) Notice: Subject to any disclaimer, the term of this patent is extended or adjusted under 35 U.S.C. 154(b) by 216 days.

(21) Appl. No.: 14/078,625

(22) Filed: Nov. 13, 2013

(65) Prior Publication Data

US 2015/0129690 A1 May 14, 2015

(51) Int. Cl.

| | |
|---|---|
| ***B05B 5/00*** | (2006.01) |
| ***F23D 11/32*** | (2006.01) |
| ***B05B 5/04*** | (2006.01) |

(52) U.S. Cl.

CPC ..... *B05B 5/0407* (2013.01); *Y10T 29/49401* (2015.01)

(58) Field of Classification Search

CPC .... B05B 5/0407; B05B 5/0415; B05B 5/025; B05B 5/0533; B05B 5/0426

USPC ..... 239/690, 695, 700, 705, 706, 225.1

See application file for complete search history.

(56) References Cited

U.S. PATENT DOCUMENTS

| | | | | |
|---|---|---|---|---|
| 3,219,276 | A | 11/1965 | Norris | |
| 4,561,592 | A | 12/1985 | Fender et al. | |
| 5,298,277 | A | 3/1994 | Hirose | |
| 5,320,283 | A | 6/1994 | Hollstein et al. | |
| 5,636,798 | A | 6/1997 | Buschor | |
| 6,623,561 | B2 * | 9/2003 | Vetter et al. | 118/314 |
| 6,817,553 | B2 | 11/2004 | Steur | |
| 7,762,207 | B2 * | 7/2010 | Endregaard et al. | 118/313 |
| 8,192,800 | B2 | 6/2012 | Endregaard et al. | |
| 2004/0159724 | A1 * | 8/2004 | van der Steur | 239/690 |
| 2007/0009656 | A1 | 1/2007 | Nagase et al. | |

FOREIGN PATENT DOCUMENTS

EP 1884365 A1 2/2008

* cited by examiner

*Primary Examiner* — Davis Hwu

(74) *Attorney, Agent, or Firm* — Armstrong Teasdale LLP

(57) ABSTRACT

An electrostatic painting apparatus is provided. The electrostatic painting apparatus includes a body, a plurality of rotary atomizers included at least partially within the body, wherein each rotary atomizer is configured to electrostatically apply a coating material to a conductive substrate, and wherein each rotary atomizer is independently controllable, and a single high voltage cascade coupled to the plurality of rotary atomizers and configured to provide a high voltage to each rotary atomizer such that the same voltage is applied to each rotary atomizer.

17 Claims, 8 Drawing Sheets

FIG. 7
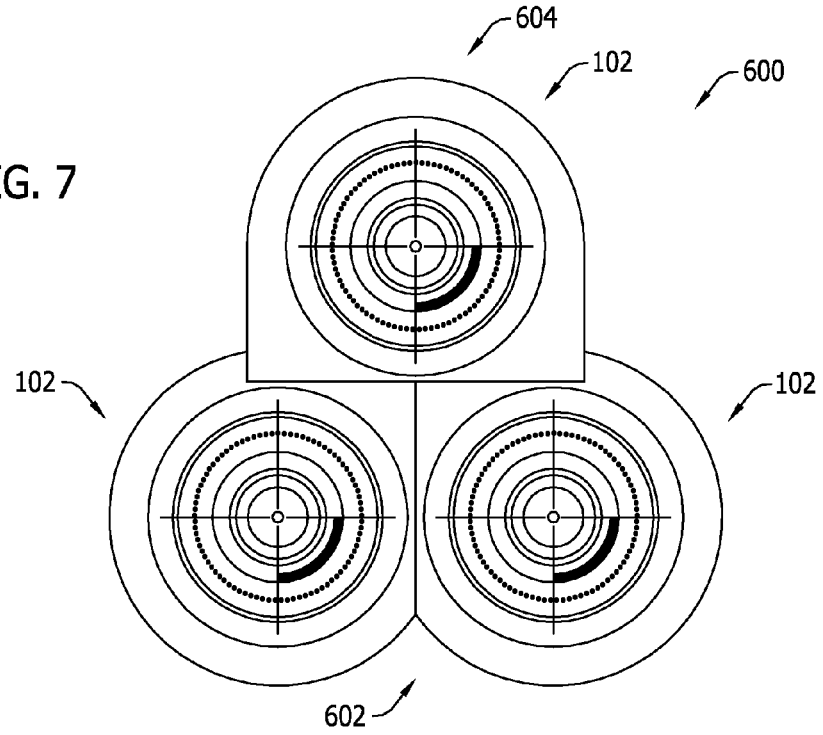
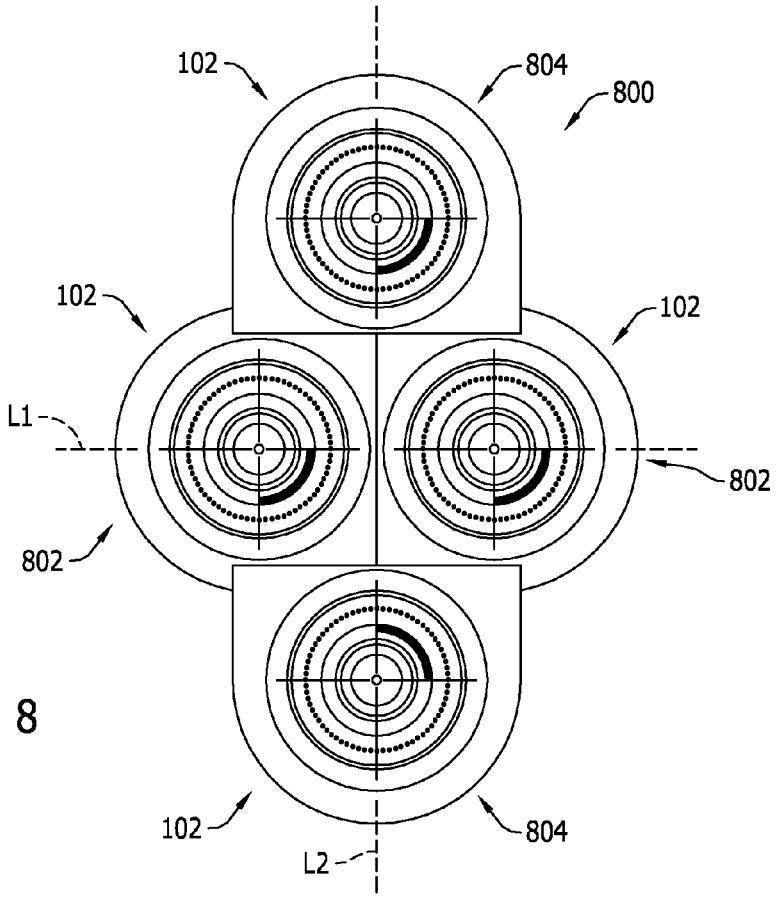
FIG. 8

MULTI-HEAD ELECTROSTATIC PAINTING APPARATUS

BACKGROUND

The field of the disclosure relates generally to electrostatic painting, and more specifically, to an electrostatic painting apparatus including a plurality of rotary atomizers.

At least some known manufacturing processes use rotary atomizers mounted to robotic arms to apply a coating material (e.g., paint) to a substrate (e.g., a vehicle body). Using robots increases assembly line speeds and increases the rate at which coating material is supplied to the substrate. The robots are programmed to follow contours of the substrate while maintaining a constant distance between the rotary atomizers and the substrate.

Industry demand has pushed for smaller painting arrangements, resulting in paint applications systems that include fewer robots and fewer rotary atomizers. In order to maintain painted substrate output at a desired level, the rotary atomizers and robots are operated at higher speeds with higher coating material application rates. For example at least some known atomizers operate at rotation speeds of 40,000-70,000 revolutions per minute (rpm). Rotation speeds this fast impart high centripetal force on the emitted paint particles, and increase the pressures/volumes of shaping air needed to control the flow of the particles. Further, robots may have motion speeds up to 1200 millimeters per second (mm/sec) to maintain pain application system output at a desired level. However, high robot motion speeds may add a side force to the paint pattern, causing the pattern to trail behind the atomizer. This may be overcome with higher pressures/volumes of shaping air, which consequently may cause particles to bounce off of the substrate instead of attaching to the substrate.

Typically, a separate high voltage power supply is used to provide power to each atomizer involved in the painting process (i.e., one high voltage power supply per atomizer). To prevent high voltage arcing, for every 10 kV potential difference, components should be separated by approximately one inch. For separate electrostatic rotary atomizers having separate high voltage cascades, at least a slight potential difference between the atomizers occurs. Accordingly, such rotary atomizers should be sufficiently separated to prevent high voltage arcing between them. For example, if 70 kV is applied to two atomizers by two separate high voltage power supplies, the atomizers would need to be spaced a minimum of seven inches apart from one another to avoid arcing. Accordingly, for atomizers having separate high voltage power supplies, in order to prevent arcing, relatively compact arrangements of the atomizers may not be possible.

Accordingly, at least some known electrostatic painting systems include robots running at high motion speeds, with high paint material delivery rates, high atomizer rotation speeds, and high pressure/volume shaping air. Operating at these high parameters is relatively expensive and complicated, and may ultimately negate the benefits of electrostatic painting

BRIEF DESCRIPTION

In one aspect, an electrostatic painting apparatus is provided. The electrostatic painting apparatus includes a body, a plurality of rotary atomizers included at least partially within the body, wherein each rotary atomizer is configured to electrostatically apply a coating material to a conductive substrate, and wherein each rotary atomizer is independently controllable, and a single high voltage cascade coupled to the plurality of rotary atomizers and configured to provide a high voltage to each rotary atomizer such that the same voltage is applied to each rotary atomizer.

In another aspect, an electrostatic painting system is provided. The electrostatic painting system includes a conductive substrate, a robot, and an electrostatic painting apparatus coupled to the robot and configured to apply a coating material to the conductive substrate. The electrostatic painting apparatus includes body, a plurality of rotary atomizers included at least partially within the body, wherein each rotary atomizer is configured to electrostatically apply coating material to the conductive substrate, and wherein each rotary atomizer is independently controllable, and a single high voltage cascade coupled to the plurality of rotary atomizers and configured to provide a high voltage to each rotary atomizer such that the same voltage is applied to each rotary atomizer.

In yet another aspect, a method for assembling an electrostatic painting apparatus is provided. The method includes including a plurality of rotary atomizers at least partially within a single body, wherein each rotary atomizer is configured to electrostatically apply a coating material to a conductive substrate, and wherein each rotary atomizer is independently controllable, and coupling a single high voltage cascade to the plurality of rotary atomizers, wherein the single high voltage cascade is configured to apply the same voltage to each rotary atomizer.

The features, functions, and advantages that have been discussed can be achieved independently in various embodiments or may be combined in yet other embodiments, further details of which can be seen with reference to the following description and drawings.

BRIEF DESCRIPTION OF THE DRAWINGS

FIG. 7 is a front view of the electrostatic painting apparatus shown in FIG. 6.

FIG. 8 is a front view of a fifth alternative embodiment of the electrostatic painting apparatus shown in FIG. 1.

DETAILED DESCRIPTION

The methods and systems described herein facilitate electrostatically applying a coating material with an apparatus that includes a plurality of rotary atomizers coupled within a single body. All of the rotary atomizers are supplied high voltage by a single high voltage cascade. Accordingly, arcing between the atomizers will not occur, and the rotary atomizers may be located proximate to one another, enabling an array of possible configurations and arrangements of the rotary atomizers.

As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
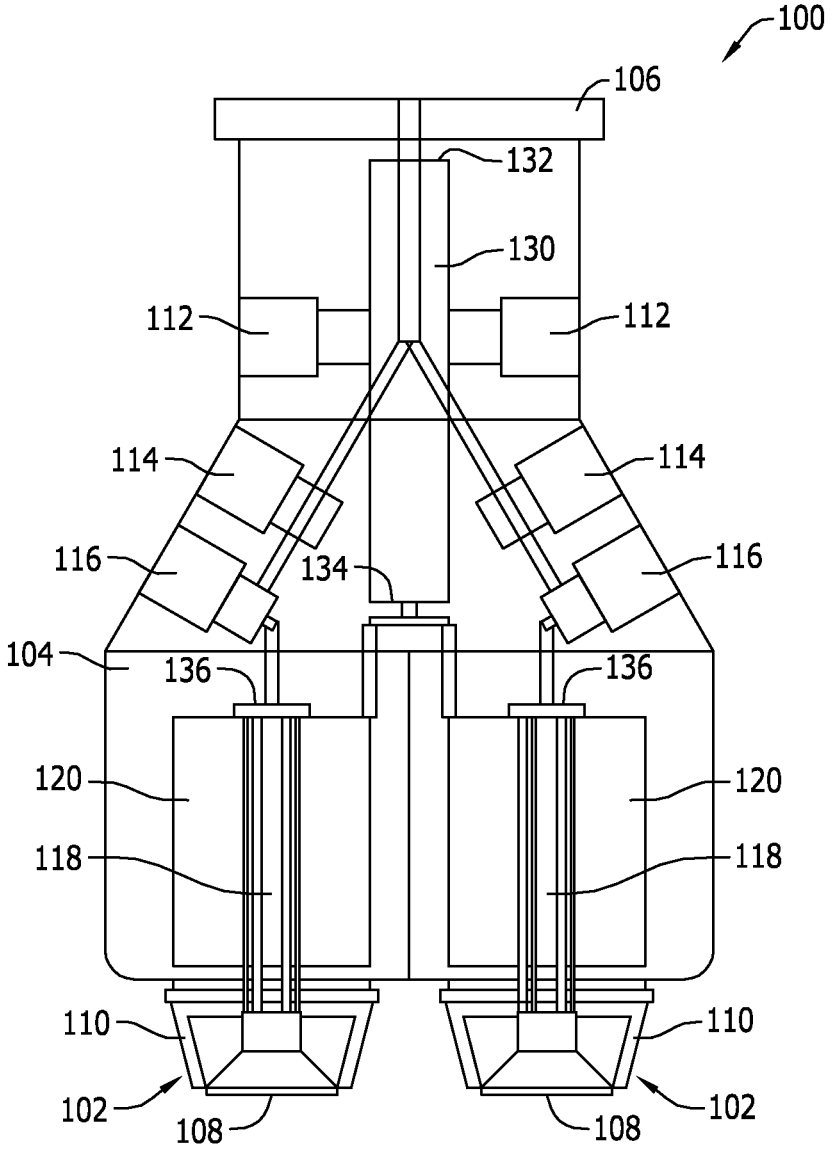
FIG. 1 is a schematic plan view of an exemplary embodiment of an electrostatic painting apparatus.
Figure 2:
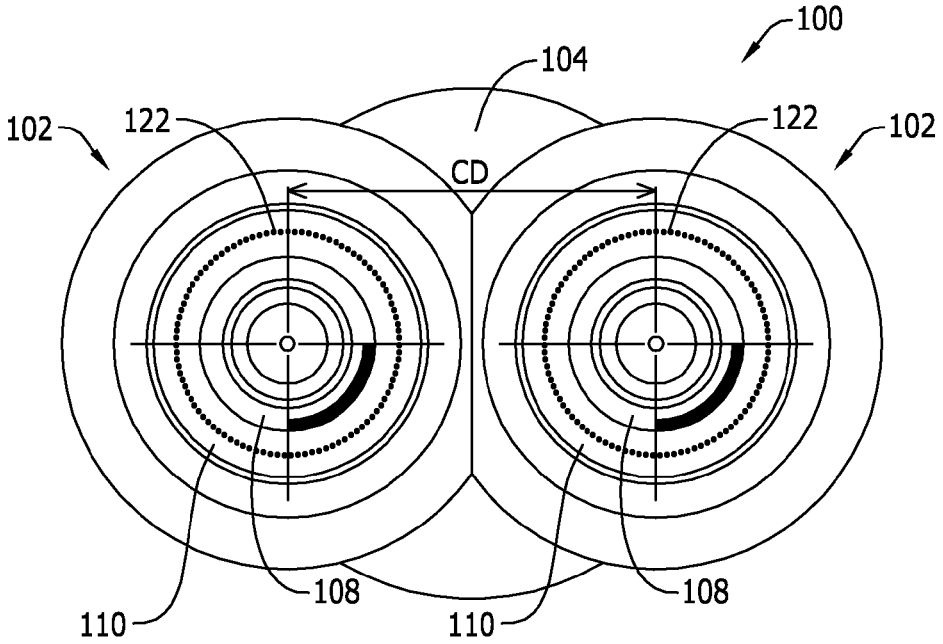
FIG. 2 is a front view of the electrostatic painting apparatus shown in FIG. 1.

FIG. 1 is a plan view of an exemplary electrostatic painting apparatus 100 that includes a plurality of rotary atomizers 102. FIG. 2 is a front view of electrostatic painting apparatus 100. In the embodiment shown in FIGS. 1 and 2, electrostatic painting apparatus 100 includes two rotary atomizers 102 contained in a single body 104. Alternatively, electrostatic painting may include any number of rotary atomizers that enable electrostatic painting apparatus 100 to function as described herein.

Electrostatic painting apparatus 100 sprays a coating material (e.g., a primer, basecoat, or clearcoat material) onto a conductive substrate (e.g., an exterior surface of a vehicle). Specifically, electrostatic painting apparatus 100 causes an electrostatic charge to be applied to particles of the coating material such that the particles are attracted to the conductive substrate, as described in detail herein. To prevent electrostatic buildup, the conductive substrate is electrically grounded.

In the exemplary embodiment, electrostatic painting apparatus 100 is mounted to a wrist of a robot (not shown) via a mounting flange 106. The robot may be any machine capable of motion to control a position and orientation of electrostatic painting apparatus 100 as described herein. To facilitate reducing downtime, mounting flange 106 enables electrostatic painting apparatus 100 to be mounted or detached from the robot wrist relatively quickly. The robot wrist is moveable about multiple axes to control a position and orientation of electrostatic painting apparatus 100 to precisely control application of the coating material to the conductive substrate. Alternatively, electrostatic painting apparatus 100 may be implemented in systems that do not include a robot.

Each rotary atomizer 102 includes a bell cup 108, also referred to as an atomizing head, and a shaping ring 110. A centerline distance, CD, between each bell cup 108 is determined by a size of each bell cup 108 and the overall pattern of coating material to be generated. For example, each bell cup 108 may have a size of 30 millimeters (mm), 50 mm, 70 mm, or 100 mm. In some embodiments, each bell cup 108 has the same size. In other embodiments, bell cups 108 may have different sizes.

A hose bundle (not shown) supplies air, paint, and solvent to electrostatic painting apparatus 100 at a plurality of valves. Specifically, each rotary atomizer 102 is in fluid communication with a solvent flush valve 112, a coating material dump valve 114, and a coating material trigger valve 116. Solvent flush valve 112 provides solvent to an associated rotary atomizer 102 for flushing the atomizer, coating material dump valve 114 facilitates releasing pressure from electrostatic painting apparatus 100 by venting to the atmosphere or waste recovery system, and coating material trigger valve 116 selectively supplies coating material to an associated rotary atomizer 102. Each rotary atomizer 102 includes a feed tube 118 for channeling fluids between valves 112, 114, and 116 and bell cup 108. In the exemplary embodiment, valves 112, 114, and 116 are radial mounted to facilitate relatively quick repair and/or replacement.

As each rotary atomizer 102 has an independent solvent flush valve 112, coating material dump valve 114, and coating material trigger valve 116, each rotary atomizer 102 is independently controllable. Each rotary atomizer 102 also independently receives air for driving a respective turbine motor 120 and shaping a pattern of coating material sprayed from rotary atomizers 102. Specifically, air emitted from shaping rings 110 controls the pattern of the sprayed coating material. A rotation speed of each turbine motor 120 is also independently controllable (e.g., by separate fiber optic cables) in the exemplary embodiment. Turbine motor 120 may be, for example, an air bearing turbine motor or a ball bearing turbine motor.

Turbine motor 120 rotates an associated bell cup 108 at speeds ranging from, for example, 20,000 revolutions per minute (rpm) to 100,000 rpm. In the exemplary embodiment, turbine motors 120 rotate bell cups 108 in a range from 20,000 rpm to 70,000 rpm. The rotation of bell cup 108 forces coating material to an outer, serrated edge of bell cup 108, atomizing the coating material into particles. The shaping air from shaping ring 110 exits at air holes 122 (shown in FIG. 2) and forces the atomized coating material towards the conductive substrate in a desired pattern. Further, shaping rings 110 may be configured to blend coating materials from multiple rotary atomizers 102 into a single pattern on the substrate, allowing greater surface area to be coated than if a single rotary atomizer were used. In some embodiments, electrostatic painting apparatus 100 includes a larger shaping ring (not shown) that shapes particles emitted from more than one rotary atomizer 102.

A high voltage cascade 130 supplies a high voltage and current to rotary atomizers 102 to charge particles of the coating material. In the embodiment shown in FIG. 1, high voltage cascade 130 is an internal cascade located within body 104. Alternatively, high voltage cascade 130 may be an external cascade that is external to body 104. High voltage cascade 130 receives power from a power source (not shown). Typically the power is supplied by an AC power source at a voltage level lower than that used for electrostatic painting. High voltage cascade 130 converts the low voltage supplied by the power source to a higher DC voltage level. At a high voltage end 134, high voltage cascade 130 may provide up to 140,000 VDC at current levels of less than 1 amp. Internal high voltage contacts 136 supply the high signal from high voltage cascade 130 to bell cups 108.

In the exemplary embodiment, a single high voltage cascade 130 supplies voltage to all rotary atomizers 102 in electrostatic painting apparatus 100. With high voltage cascade 130 activated, current flows as air around each rotary atomizer 102 is charged. Further, when the coating material flows from coating material trigger valves 116, additional current is pulled from high voltage cascade 130. As bell cups 108 approach the electrically grounded substrate to apply coating material, still more current is pulled from high voltage cascade 130. In the exemplary embodiment, high voltage cascade 130 provides a voltage of up to approximately 100 kilovolts (kV) and a current in a range of 15 micro-amps to 150 micro-amps to each rotary atomizer 102. Alternatively, high voltage cascade 130 may supply any amount of current and/or voltage that enables electrostatic painting apparatus 100 to function as described herein.

When rotary atomizers 102, operating at a high voltage, approach the electrically grounded substrate, the difference in voltage between rotary atomizers 102 and the substrate causes a current flow between the two in an attempt to equalize the potential difference. This will occur even at relatively low levels of voltage difference (e.g., less than 1 kV) between rotary atomizers 102 and the substrate.

In the exemplary embodiment, a single high voltage cascade 130 provides high voltage to all rotary atomizers 102. As such, atomizers 102 are operating at exactly the same potential, and do not require a minimum separation to prevent arcing, facilitating a more compact arrangement of rotary atomizers 102 than at least some known electrostatic painting apparatuses. A more compact arrangement facilitates including more rotary atomizers 102 on a single robot. Further, a plurality of closely-arranged rotary atomizers 102 operating at lower motion speeds can be used to apply the same amount of coating material as a single atomizer operating at a higher motion speed.

As explained above, rotary atomizers 102 are selectively controllable independent of one another (e.g., one atomizer 102 may apply coating material to the substrate while the other atomizer 102 does not). However, to avoid arcing between atomizers, in the exemplary embodiment, regardless of whether a particular atomizer 102 is applying coating material, high voltage cascade 130 supplies high voltage to all atomizers 102 in body 104. Further, in the exemplary embodiment, regardless of whether a particular atomizer 102 is currently applying coating material, turbine motor 120 drives an associated bell cup 108. Accordingly, to activate or deactivate each atomizer 102, the flow of coating material to each atomizer 102 is controlled (e.g., by controlling coating material trigger valves 116). As rotary atomizers 102 are independently controllable, a large paint pattern can be created by activating all rotary atomizers 102, and a smaller paint pattern can be created by deactivating at least one rotary atomizer 102.

The electrostatic painting apparatus 100 shown in FIGS. 1 and 2 includes an exemplary configuration of two rotary atomizers 102. As explained herein, a number of different atomizer configurations are possible using the systems and methods described herein. Unless otherwise noted, the alternative embodiments described herein function in a substantially similar manner to electrostatic painting apparatus 100.

In the embodiment shown in FIGS. 1 and 2, electrostatic painting apparatus 100 includes two rotary atomizers 102 in an inline configuration. As shown in FIG. 2, the centerline distance CD between rotary atomizers 102 is approximately 100 mm.

Notably, although the centerline distance CD is approximately 100 mm in the embodiment shown in FIG. 2, this centerline distance CD and the other centerline distances CD specified herein are exemplary. Accordingly, the centerline distance CD may be any distance that enables the electrostatic painting apparatus described herein to function as described herein. For example, the centerline distance CD may be in a range from approximately 100 mm to approximately 500 mm.

Figure 3:
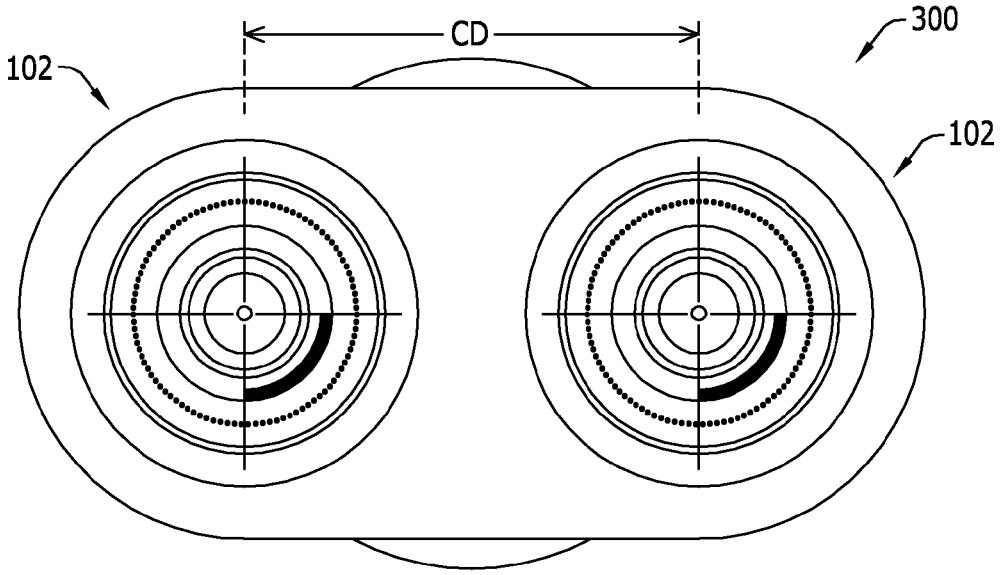
FIG. 3 is a front view of a first alternative embodiment of the electrostatic painting apparatus shown in FIG. 1.

FIG. 3 is a front view of a first alternative embodiment 300 of the electrostatic painting apparatus 100 (shown in FIG. 1). In the first alternative embodiment, electrostatic painting apparatus 300 includes two inline rotary atomizers 102. As compared to electrostatic painting apparatus 100, the centerline distance CD between rotary atomizers 102 is greater in alternative electrostatic painting apparatus 300. Specifically, in the exemplary embodiment, the centerline distance CD between rotary atomizers 102 in alternative electrostatic painting apparatus 300 is approximately 130 mm. Alternatively, the centerline distance CD between rotary atomizers 102 may be any distance that enables alternative electrostatic painting apparatus 300 to function as described herein.

Figure 4:
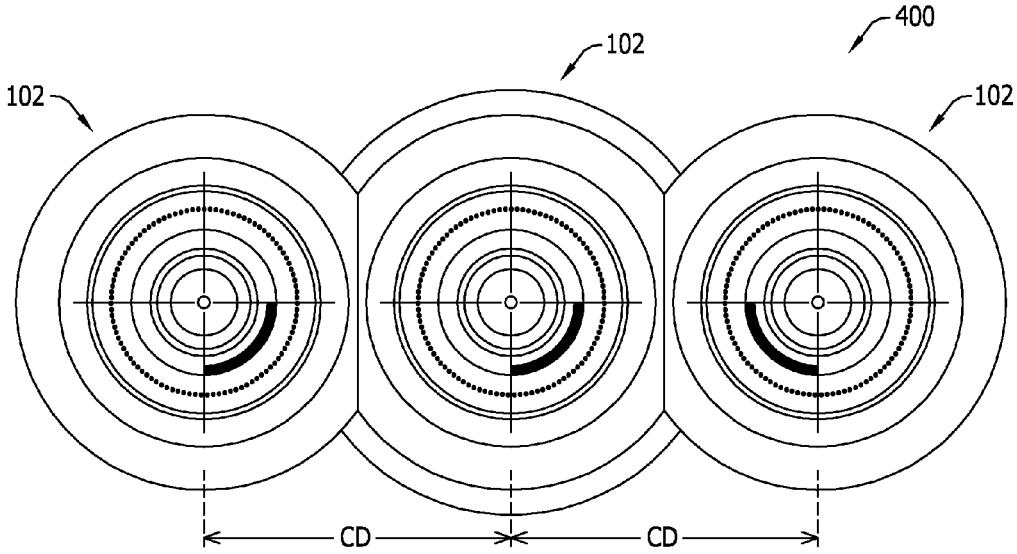
FIG. 4 is a front view of a second alternative embodiment of the electrostatic painting apparatus shown in FIG. 1.
Figure 5:
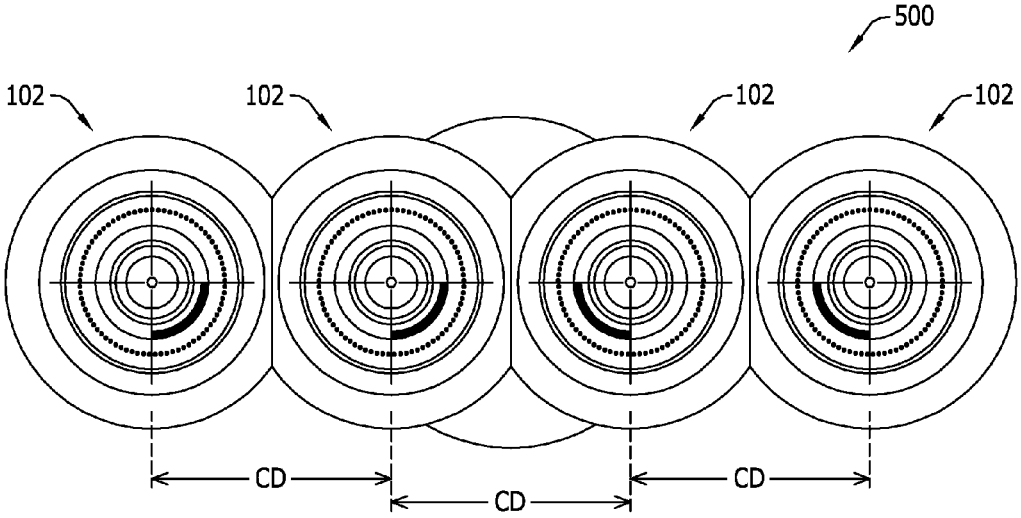
FIG. 5 is a front view of a third alternative embodiment of the electrostatic painting apparatus shown in FIG. 1.

FIG. 4 is a front view of a second alternative embodiment 400 of the electrostatic painting apparatus 100 (shown in FIG. 1). In the second alternative embodiment, electrostatic painting apparatus 400 includes three inline rotary atomizers 102 with a centerline distance CD of approximately 100 mm. FIG. 5 is a front view of a third alternative embodiment 500 of an electrostatic painting apparatus 100 (shown in FIG. 1). In the third alternative embodiment, electrostatic painting apparatus 500 includes four inline rotary atomizers 102 with a centerline distance CD of approximately 100 mm.

Figure 6:
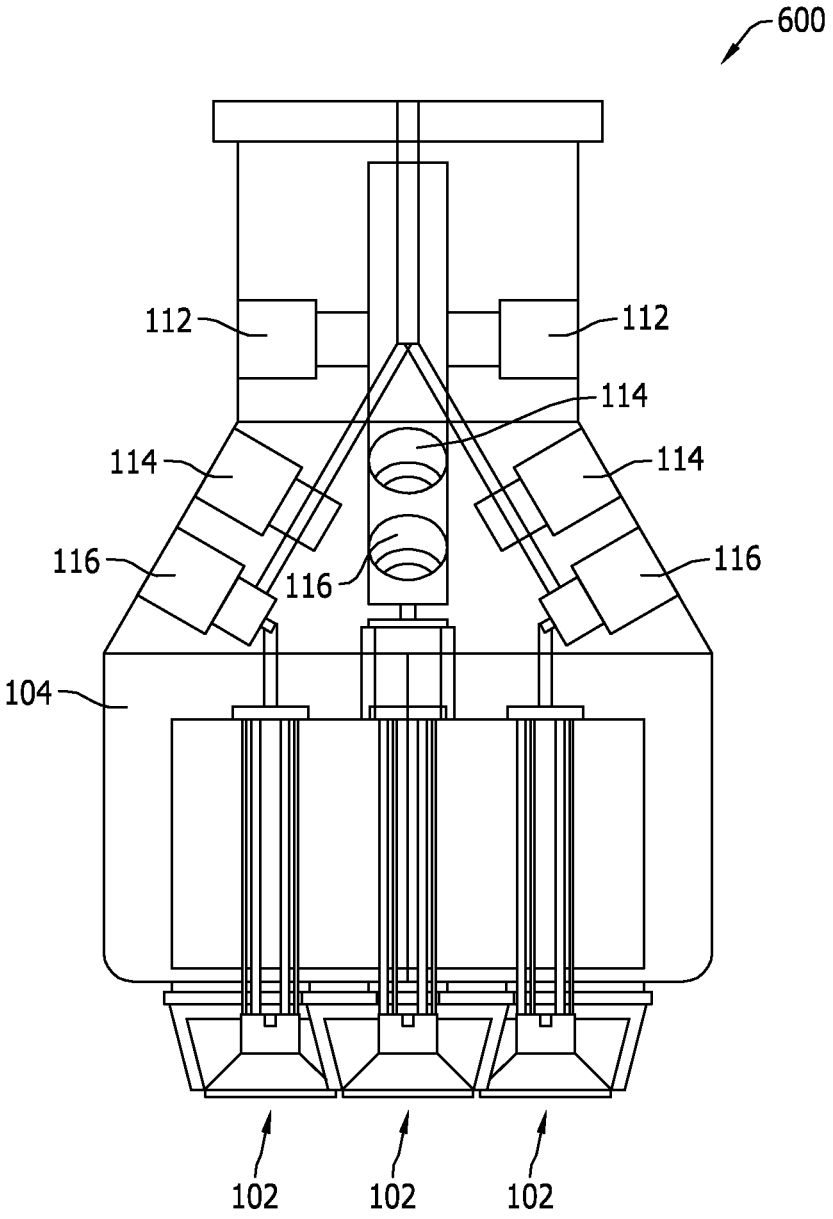
FIG. 6 is a schematic plan view of a fourth alternative embodiment of the electrostatic painting apparatus shown in FIG. 1.

FIG. 6 is a schematic plan view of a fourth alternative embodiment 600 of the electrostatic painting apparatus 100 (shown in FIG. 1). FIG. 7 is a front view of alternative electrostatic painting apparatus 600. As shown in FIGS. 6 and 7, in the fourth alternative embodiment, electrostatic painting apparatus 600 includes three rotary atomizers 102 in a stacked configuration. That is, alternative electrostatic painting apparatus 600 includes a pair 602 of inline rotary atomizers 102, and a third rotary atomizer 604 offset from pair 602.

FIG. 8 is a front view of a fifth alternative embodiment 800 of the electrostatic painting apparatus 100 (shown in FIG. 1). In the fifth alternative embodiment, electrostatic painting apparatus 800 includes four rotary atomizers 102 in a cross-pair configuration. Specifically, alternative electrostatic painting apparatus 800 includes a first pair 802 of inline rotary atomizers 102 aligned along a first line, L1, and a second pair 804 of inline rotary atomizers 102 aligned along a second line, L2, that is perpendicular to first line L1.

Figure 9:
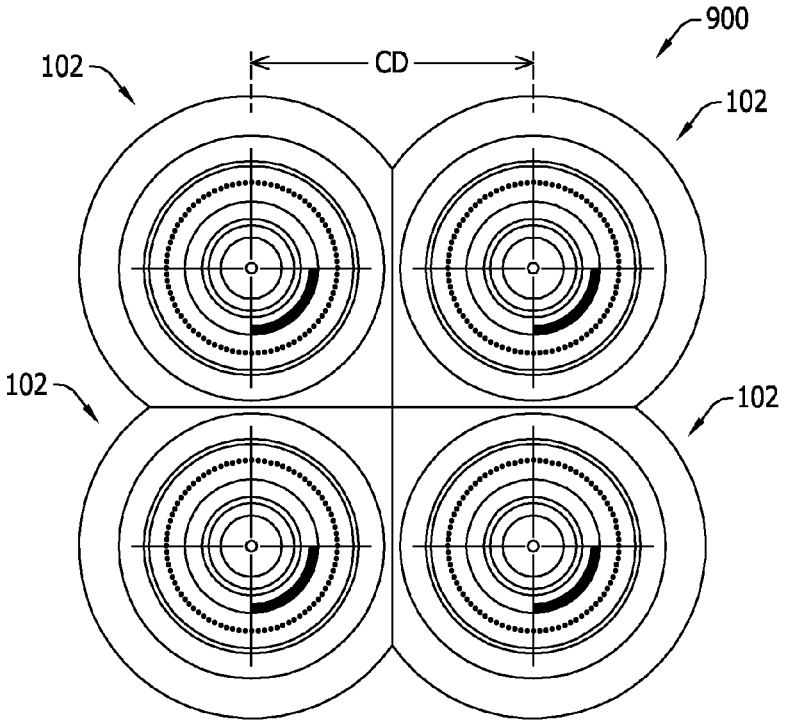
FIG. 9 is a front view of a sixth alternative embodiment of the electrostatic painting apparatus shown in FIG. 1.

FIG. 9 is a front view of a sixth alternative embodiment 900 of the electrostatic painting apparatus 100 (shown in FIG. 1). In the sixth alternative embodiment, electrostatic painting apparatus 900 includes four rotary atomizers 102 in a quad configuration. Specifically, rotary atomizers 102 are arranged in a grid, with a centerline distance CD of approximately 100 mm between adjacent rotary atomizers 102.

Figure 10:
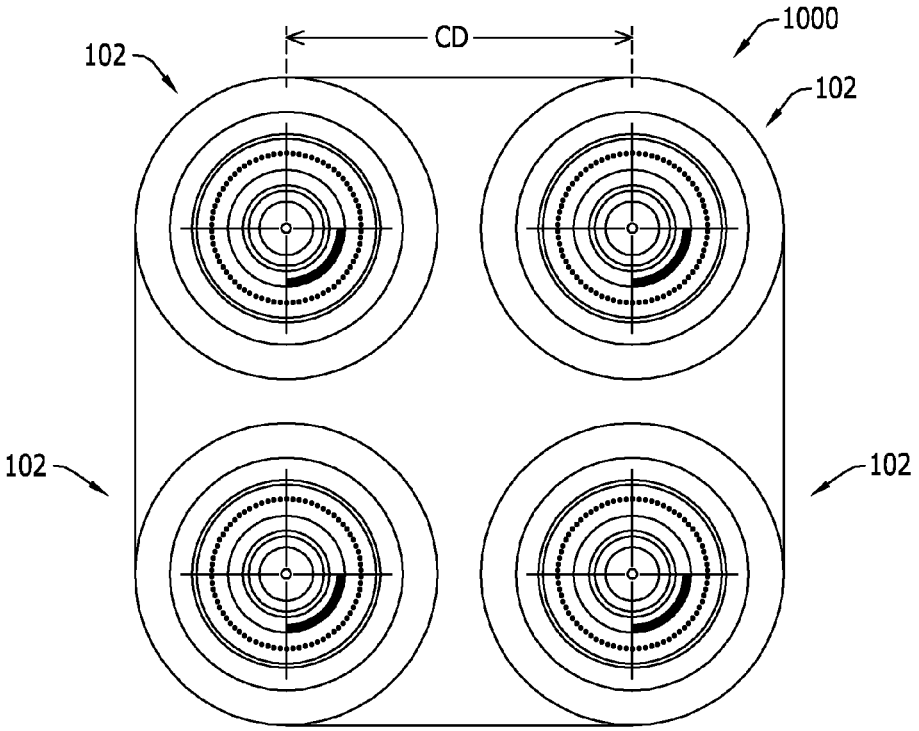
FIG. 10 is a front view of a seventh alternative embodiment of the electrostatic painting apparatus shown in FIG. 1.

FIG. 10 is a front view of a seventh alternative embodiment 1000 of the electrostatic painting apparatus 100 (shown in FIG. 1). In the seventh alternative embodiment, electrostatic painting apparatus 1000 includes four rotary atomizers 102 in a quad configuration. However, as compared to alternative electrostatic painting apparatus 900, the rotary atomizers 102 in alternative electrostatic painting apparatus 1000 are separated by a greater centerline distance CD of approximately 150 mm.

Figure 11:
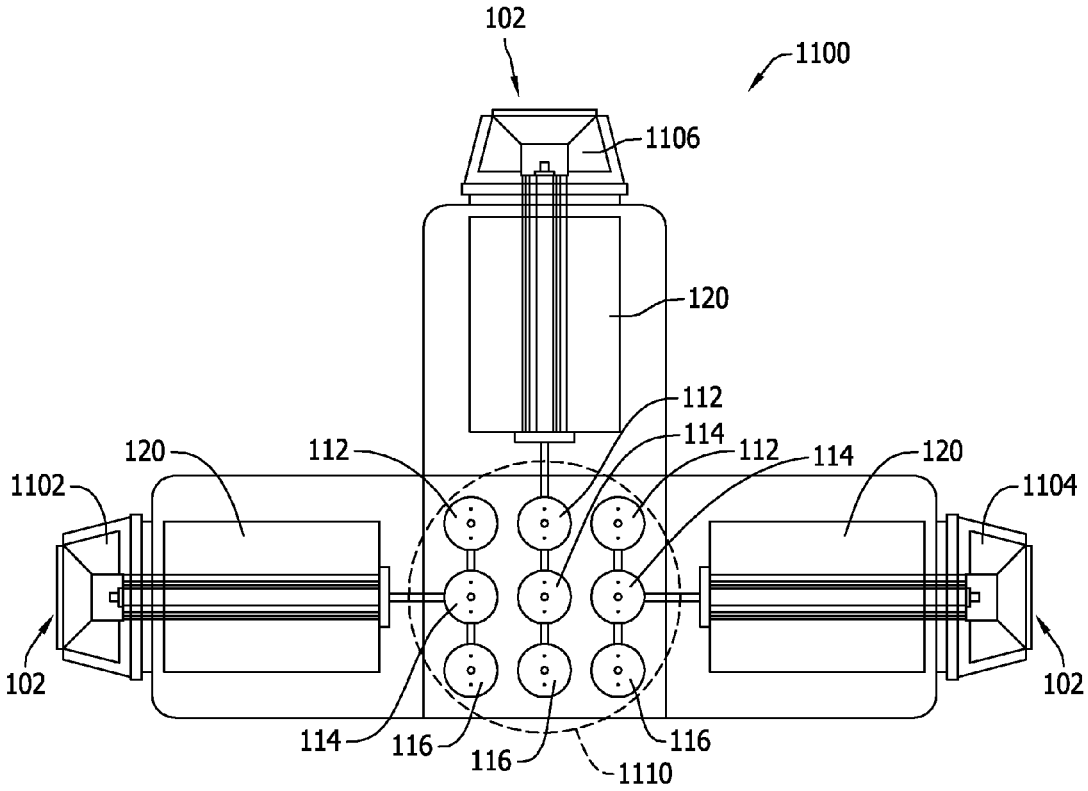
FIG. 11 is a schematic plan view of an eighth alternative embodiment of the electrostatic painting apparatus shown in FIG. 1.
Figure 12:
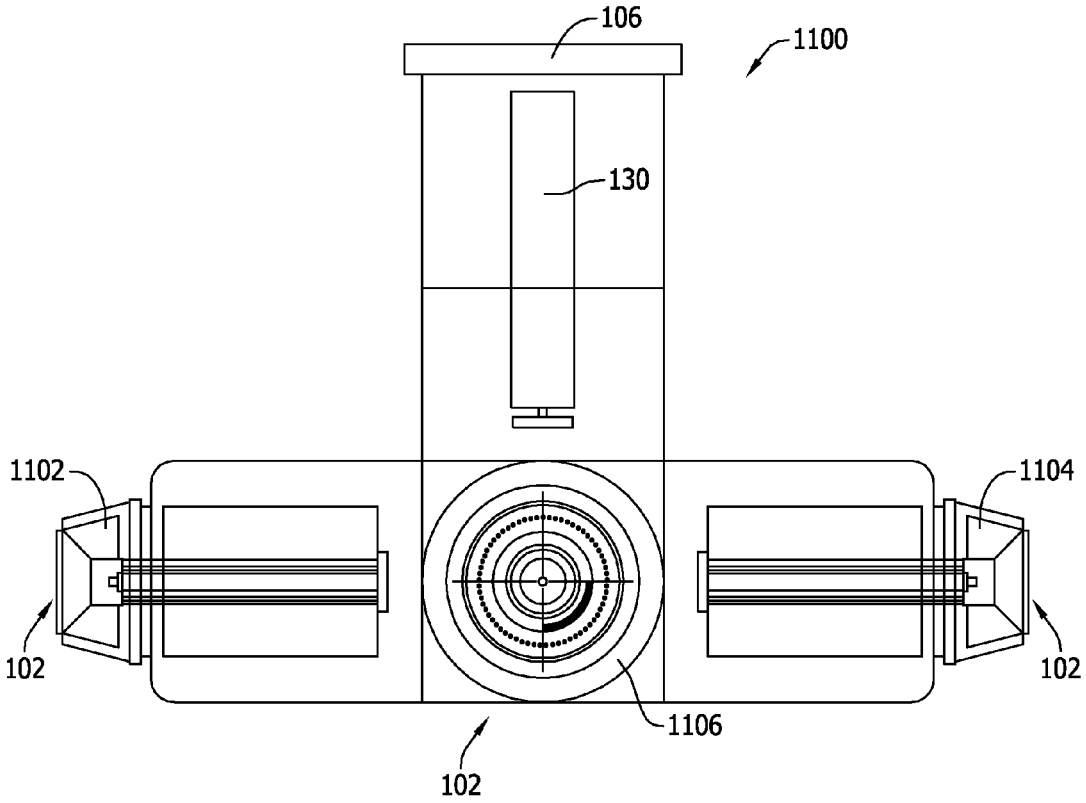
FIG. 12 is a front view of the electrostatic painting apparatus shown in FIG. 11.

FIG. 11 is a schematic plan view of an eighth alternative embodiment 1100 of the electrostatic painting apparatus 100 (shown in FIG. 1). In the eighth alternative embodiment, electrostatic painting apparatus 1100 includes three rotary atomizers 102 in a T-configuration. FIG. 12 is a front view of alternative electrostatic painting apparatus 1100. As shown in FIGS. 11 and 12, alternative electrostatic painting apparatus 1100 includes a first rotary atomizer 1102 oriented to apply coating material in a first direction, a second rotary atomizer 1104 oriented to apply coating material in a second direction opposite the first direction, and a third rotary atomizer 1106 oriented to apply coating material in a third direction perpendicular to both the first and second directions. Alternative electrostatic painting apparatus 1100 include a manifold 1110 that includes solvent flush valves 112, coating material dump valves 114, and coating material trigger valves 116 for each rotary atomizer 102.

In the exemplary embodiment, each rotary atomizer 102 has a bell cup 108 with a different size. In one example, first rotary atomizer 1102 has a 30 mm bell cup 108, second rotary atomizer 1104 has a 50 mm bell cup 108, and third rotary atomizer 1106 has a 70 mm bell cup 108. Accordingly, the bell cup size being used to apply coating material can be switched relatively quickly by rotating alternative electrostatic painting apparatus 1100 (e.g., using a robot), and selectively activating/deactivating rotary atomizers 1102, 1104, and 1106.

Although a number of exemplary configurations are described herein, those of skill in the art will appreciate that arrangements of rotary atomizers other than those explicitly shown are possible using the systems and methods described herein. For example, in some embodiments, rotary atomizers may be arranged in a circular configuration.

At least some known electrostatic painting apparatuses utilize a single rotary atomizer to apply coating material to a substrate. To apply enough coating material sufficiently quickly, the single rotary atomizer operates at a relatively high rotation speed (requiring higher pressures/volumes of shaping air to direct the particles), uses a relatively large bell cup, and operates at a relatively high coating material delivery rate. Further, the motion speed of the robot that controls the position of the single rotary atomizer is also relatively high. These operating parameters may be relatively expensive to implement.

However, using the systems and methods described herein, a plurality of rotary atomizers are arranged on a single body. Accordingly, as compared to single rotary atomizer designs, each of plurality of rotary atomizers can be operated at a lower rotation speed, have a smaller bell cup, and operate at a lower coating material delivery rate, while cooperating to still apply coating material at the same rate as the single rotary atomizer. For example, a single rotary atomizer applying coating material at 450 cc/min is equivalent to two rotary atomizers each applying coating material at 225 cc/min. Further, a robot positioning a plurality of rotary atomizers may move slower than a robot operating a single rotary atomizer while still applying coating material at the same rate. Accordingly, the electrostatic painting apparatuses described herein may be significantly less expensive to operate than at least some known single rotary atomizer designs.

The embodiments described herein facilitate electrostatically applying a coating material with an apparatus that includes a plurality of rotary atomizers coupled within a single body. All of the rotary atomizers are supplied high voltage by a single high voltage cascade. Accordingly, arcing between the atomizers will not occur, and the rotary atomizers may be located proximate to one another, enabling an array of possible configurations and arrangements of the rotary atomizers.

Exemplary embodiments of electrostatic painting apparatuses for applying coating material to a substrate are described above in detail. The systems and methods are not limited to the specific embodiments described herein, but rather, components of the systems and/or steps of the methods may be utilized independently and separately from other components and/or steps described herein. For example, the systems may also be used in combination with other manufacturing systems and methods, and are not limited to practice with only the manufacturing systems and methods as described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrostatic painting apparatus comprising:

a body;

a plurality of rotary atomizers included at least partially within said body, wherein each rotary atomizer is configured to electrostatically apply a coating material to a conductive substrate, and wherein each rotary atomizer is independently controllable;

a single high voltage cascade coupled to said plurality of rotary atomizers and configured to provide a high voltage to each rotary atomizer such that the same voltage is applied to each rotary atomizer;

a plurality of solvent flush valves;

a plurality of coating material dump valves; and a plurality of coating material trigger valves, wherein each rotary atomizer is coupled in flow communication with one of said solvent flush valves, one of said coating material dump valves, and one of said coating material trigger valves.

2. An electrostatic painting apparatus in accordance with claim 1, wherein said plurality of rotary atomizers comprise at least three rotary atomizers arranged in an inline configuration.

3. An electrostatic painting apparatus in accordance with claim 1, wherein said plurality of rotary atomizers comprise three rotary atomizers arranged in a T-shaped configuration.

4. An electrostatic painting apparatus in accordance with claim 1, wherein said single high voltage cascade is an internal high voltage cascade included at least partially within said body.

5. An electrostatic painting apparatus in accordance with claim 1, wherein each rotary atomizer comprises:

a bell cup;

a turbine motor coupled to said bell cup and configured to rotate said bell cup; and a shaping ring configured to emit air to control a flow of coating material particles exiting the rotary atomizer.

6. An electrostatic painting apparatus in accordance with claim 5, wherein a diameter of a bell cup of a first rotary atomizer is different than a diameter of a bell cup of a second rotary atomizer.

7. An electrostatic painting system comprising:

a conductive substrate;

a robot; and an electrostatic painting apparatus coupled to said robot and configured to apply a coating material to said conductive substrate, said electrostatic painting apparatus comprising:

a body;

a plurality of rotary atomizers included at least partially within said body, wherein each rotary atomizer is configured to electrostatically apply coating material to said conductive substrate, and wherein each rotary atomizer is independently controllable;

a single high voltage cascade coupled to said plurality of rotary atomizers and configured to provide a high voltage to each rotary atomizer such that the same voltage is applied to each rotary atomizer;

a plurality of solvent flush valves;

a plurality of coating material dump valves; and a plurality of coating material trigger valves, wherein each rotary atomizer is coupled in flow communication with one of said solvent flush valves, one of said coating material dump valves, and one of said coating material trigger valves.

8. An electrostatic painting system in accordance with claim 7, wherein said plurality of rotary atomizers comprise at least three rotary atomizers arranged in an inline configuration.

9. An electrostatic painting system in accordance with claim 7, wherein said plurality of rotary atomizers comprise three rotary atomizers arranged in a T-shaped configuration.

10. An electrostatic painting system in accordance with claim 7, wherein said single high voltage cascade is configured to apply the same voltage to each rotary atomizer regardless of whether each rotary atomizer is currently applying coating material.

11. An electrostatic painting system in accordance with claim 7, wherein each rotary atomizer comprises:

a bell cup;

a turbine motor coupled to said bell cup and configured to rotate said bell cup; and a shaping ring configured to emit air to control a flow of coating material particles exiting the rotary atomizer.

12. An electrostatic painting system in accordance with claim 11, wherein a diameter of a bell cup of a first rotary atomizer is different than a diameter of a bell cup of a second rotary atomizer.

13. A method for assembling an electrostatic painting apparatus, said method comprising:

including a plurality of rotary atomizers at least partially within a single body, wherein each rotary atomizer is configured to electrostatically apply a coating material to a conductive substrate, and wherein each rotary atomizer is independently controllable;

coupling a single high voltage cascade to the plurality of rotary atomizers, wherein the single high voltage cascade is configured to apply the same voltage to each rotary atomizer; and coupling an associated solvent flush valve, an associated coating material dump valve, and an associated coating material trigger valve in fluid communication with each rotary atomizer.

14. A method in accordance with claim 13, wherein including a plurality of rotary atomizers comprises including at least three rotary atomizers arranged in an inline configuration.

15. A method in accordance with claim 14, wherein including a plurality of rotary atomizers comprises including three rotary atomizers arranged in a T-shaped configuration.

16. A method in accordance with claim 14, further comprising including the single high voltage cascade at least partially within said body.

17. A method in accordance with claim 14, further comprising mounting the body to a wrist of a robot.

* * * * *